US008726691B2

(12) United States Patent
Jibb et al.

(10) Patent No.: US 8,726,691 B2
(45) Date of Patent: May 20, 2014

(54) AIR SEPARATION APPARATUS AND METHOD

(75) Inventors: Richard John Jibb, Amherst, NY (US); Maulik R. Shelat, Gujarat (IN); Lyda Zambrano, Buffalo, NY (US)

(73) Assignee: Praxair Technology, Inc., Danbury, CT (US)

( * ) Notice: Subject to any disclaimer, the term of this patent is extended or adjusted under 35 U.S.C. 154(b) by 343 days.

(21) Appl. No.: 12/842,098

(22) Filed: Jul. 23, 2010

(65) Prior Publication Data

US 2010/0287986 A1 Nov. 18, 2010

Related U.S. Application Data

(63) Continuation-in-part of application No. 12/648,775, filed on Dec. 29, 2009, now abandoned, which is a continuation of application No. 12/363,279, filed on Jan. 30, 2009, now abandoned.

(51) Int. Cl.
*F25J 3/00* (2006.01)

(52) U.S. Cl.
USPC ..... 62/654; 62/644

(58) Field of Classification Search
CPC ..... F25J 2290/10
See application file for complete search history.

(56) References Cited

U.S. PATENT DOCUMENTS 4,555,256 A * 11/1985 Skolaude et al. ..... 62/646
4,984,686 A 1/1991 Shillington
5,082,482 A * 1/1992 Darredeau ..... 62/646
5,329,776 A * 7/1994 Grenier ..... 62/646
5,413,872 A * 5/1995 Faigle ..... 428/603
5,596,885 A * 1/1997 Grenier ..... 62/646
5,735,142 A * 4/1998 Grenier ..... 62/646
5,845,517 A * 12/1998 Attlfellner ..... 62/644
6,360,561 B2 3/2002 Allam et al.
6,430,962 B2 * 8/2002 Miura et al. ..... 62/654
6,695,044 B1 2/2004 Symonds
6,834,515 B2 * 12/2004 Sunder et al. ..... 62/643
6,951,245 B1 10/2005 Lehman (Continued)

FOREIGN PATENT DOCUMENTS

FR 2895493 A1 6/2007

OTHER PUBLICATIONS

Castle, W.F., "Modern Liquid Pump Oxygen Plants: Equipment and 1993 Performance", 89 AIChe Symposium Series 294.

(Continued)

*Primary Examiner* — John F Pettitt
(74) *Attorney, Agent, or Firm* — David M. Rosenblum

(57) ABSTRACT

The present invention relates to an air separation apparatus and method in which a pumped liquid oxygen stream is heated within a heat exchanger through indirect heat exchange with compressed air to produce an oxygen product. The liquid oxygen stream is pressurized in a range above about 55 bar(a) and no greater than about 150 bar(a) and is a supercritical fluid after having been heated within the heat exchanger. The air is compressed to an air pressure that is a function of the oxygen pressure that will result in a minimum power being expended in the compression of the air. The heat exchanger can be a brazed fin heat exchanger fabricated from aluminum in which the fins located in heat exchange passages have an undulating configuration to increase the flow path length and induce flow separation and thereby increase the heat transfer coefficient within the heat exchanger.

8 Claims, 4 Drawing Sheets

(56) References Cited

U.S. PATENT DOCUMENTS

| | | | | |
|---|---|---|---|---|
| 6,976,529 | B2 * | 12/2005 | Kester | 165/151 |
| 7,059,397 | B2 | 6/2006 | Chatel et al. | |
| 7,111,672 | B2 | 9/2006 | Symonds | |
| 7,219,719 | B2 | 5/2007 | Gerard | |
| 2003/0164233 | A1 * | 9/2003 | Wu et al. | 165/166 |
| 2007/0095100 | A1 | 5/2007 | Rankin et al. | |
| 2008/0230212 | A1 * | 9/2008 | Crayssac et al. | 165/166 |
| 2008/0307828 | A1 * | 12/2008 | Prosser et al. | 62/644 |
| 2009/0064714 | A1 * | 3/2009 | Rottmann et al. | 62/642 |

OTHER PUBLICATIONS

W. F. Castle; "Modern Liquid Pump Oxygen Plants: Equipment and Performance"; Aiche Intersociety Cryogenic Symposium, Apr. 1, 1991, pp. 14-17, XP009057309, BOC Process Plants, Guildford, Surrey, UK.

* cited by examiner

AIR SEPARATION APPARATUS AND METHOD

RELATED APPLICATIONS

This application is a continuation-in-part application of prior continuation application Ser. No. 12/648,775, filed Dec. 29, 2009, which is a continuation of, and claims priority from, application Ser. No. 12/363,279, filed Jan. 30, 2009. All of which are incorporated by reference herein in its entirety.

FIELD OF THE INVENTION

The present invention relates to an air seperation apparatus and method for forming an oxygen product as a supercritical fluid by heating a pumped liquid oxygen stream within a heat exchanger through indirect heat exchange with compressed air. More particularly, the present invention relates to such an apparatus and air separation apparatus and method in which the air pressure utilized in to heat the pumped liquid oxygen stream is selected on the basis of a function of the oxygen pressure that results in a minimum or very close to minimum expenditure of compression energy. Even more particularly, the present invention relates to such an air separation apparatus and method in which the heat exchanger is a plate-fin heat exchanger.

BACKGROUND OF THE INVENTION

There exists an increasing need for systems that are capable of supplying oxygen at very high pressures in which the oxygen exists as a supercritical fluid, namely, a fluid that is neither a vapor, solid or liquid, but is rather a dense fluid having a temperature and pressure above the supercritical point. For oxygen, this temperature and pressure would be above 154.78 K and 50.83 bar (a).

One reason for this increasing need is in the growth of gasification applications. Gasification is an environmentally friendly technology which can utilize coal or other relatively low value feedstocks and convert them into high-value products, or alternatively produce a clean source of electrical power by gasifying the feedstock within gasifiers into hydrogen and carbon monoxide containing streams. These gasifiers typically require oxygen at high pressures in which the oxygen is supplied as a supercritical fluid. Although there are many different types of gasifiers generally speaking, a low-grade carbon containing material in the presence of oxygen is converted to a hydrogen and carbon monoxide containing stream that can be further processed to be used as a fuel in the generation of electricity and/or as a source of hydrogen, or further processed to manufacture valuable products such as chemicals, fertilizers or liquid fuels. Additionally, steam is generated in such processing that can be further used to drive generators.

While such oxygen can be supplied by vaporizing liquid oxygen and then compressing the oxygen to pressure, the liquid oxygen can be pumped to a high pressure and then heated to a critical temperature at which the resulting oxygen product will exist as a supercritical fluid. Typically, the pumping operation is incorporated into a cryogenic air separation plant, although, it is possible that the pumping operation could be conducted independently of such a plant. In a cryogenic air separation plant that is used in producing the oxygen at pressure, air is compressed, purified and then cooled to a temperature suitable for its rectification in a distillation column system.

Although different distillation column systems exist for the rectification of air, a common system involves two columns, a high pressure column and a low pressure column that are thermally linked by means of a condenser reboiler. The air, after having been cooled to at or near its dew point, is then introduced into the high pressure column in which nitrogen is separated from the air to produce a nitrogen-rich column overhead and a crude liquid oxygen column bottoms. The crude liquid oxygen column bottoms is further refined in the low pressure column into an oxygen-rich liquid column bottoms and a nitrogen-rich column overhead. All or part of the nitrogen-rich column overhead produced in the high pressure column is condensed against boiling the oxygen-rich liquid column bottoms of the low pressure column to provide a reflux for both high pressure column and the low pressure column.

The liquid oxygen that is drawn from residual oxygen-rich liquid in the low pressure column is pumped to pressure and then heated in a multi-stream main heat exchanger that is used in cooling the air against one or more product streams, or in a separate heat exchanger dedicated to the heating of the oxygen. In either case, part of the air to be rectified is further compressed in a booster compressor and then used to heat the oxygen and then produce the high pressure oxygen product that can be used in a gasifier or other process requiring high pressure oxygen.

As can be appreciated from this discussion, the raw material used in producing the oxygen is the electrical power drawn, or steam consumed or fuel burned to produce the energy for compressing the air in the first instance and further compressing the air to vaporize the pumped oxygen. In this regard, since the cryogenic rectification is conducted at cryogenic temperatures and there exists thermal loss due to heat leakage, liquid products that are removed from the plant for storage, backup or merchant liquid sale and warm end losses, refrigeration must be imparted. This is commonly accomplished by further compressing part of the air to be separated and then expanding the air in a turboexpander with removal of the work of expansion. The resulting exhaust is then introduced into the distillation column system. There are other known processes for generating refrigeration in an air separation plant. The production of refrigeration represents a further energy requirement of the plant.

In order to produce oxygen at supercritical pressures, that is above pressures at which the oxygen will exist as a supercritical fluid when also, at a temperature that will set the physical state of the oxygen as a supercritical fluid, the energy expended in compressing the air must be at a minimum or near a minimum to make the production of the oxygen economically attractive. In 89 AIChE Symposium Series 294, "Modern Liquid Pump Oxygen Plants: Equipment and Performance", No. 294 by W. F. Castle, BOC Process Plants, p 14, it is mentioned that as a rule of thumb, the pressure of the air has to be about 2.3 times that of the oxygen pressure that is required. A simulation was conducted over a range of oxygen pressures in which the oxygen was vaporized by compressed air in a heat exchanger operated at a 5° C. warm end temperature difference and at an approach or pinch of the heating and cooling curves of about 1.5° C. The results were presented in graphical form. In the curve shown in the graph, at an oxygen pressure at above 40 bar, the curve flattened out from a relationship in which the required air pressure was roughly twice the oxygen pressure. It was mentioned, however, in the paper that such curve did not represent optimum conditions for the best power consumption of the plant and such optimum conditions were not presented in the paper. It was also mentioned, that the heat exchanger for air pressures below 100 bar could be a conventional brazed aluminum plate-fin heat exchanger. However, at higher pressures, more expensive coiled heat exchangers would have to be used.

U.S. Pat. No. 6,430,962-B2 also considers the production of oxygen as a supercritical fluid. In this patent, the oxygen produced in a low pressure column of an air separation plant is pumped to a supercritical pressure and then vaporized in a brazed aluminum plate-fin heat exchanger. It is mentioned that the more narrow the temperature difference between the oxygen and the air at the warm end of the heat exchanger, the lower the thermal stress within the heat exchanger. Two cases were compared, one at 0.61 Mpa less than the critical pressure of oxygen, 5.043 MPa and another far above the critical pressure, a pressure of 8.14 MPa. From the comparison, it was determined that at the subcritical pressure, the warm end temperature difference was large, 40° C. and at the high pressure, the warm end temperature difference was 12° C. This lower temperature difference would reduce the thermal stress in the heat exchanger and allow the use of a brazed aluminum plate-fin heat exchanger in such applications. However, nothing is said in this patent regarding the most efficient operation of the plant with respect to the electrical power used in compressing the air. Further, there are no details given regarding the design of the heat exchanger itself.

In U.S. Pat. No. 7,219,719 B2, a brazed aluminum plate-fin heat exchanger design is disclosed that is designed to be used at oxygen pressures above 100 bar. In this patent, straight extruded fins are used in the high pressure channels, having a sufficient thickness to withstand such high pressures. It is mentioned that the ratio of the mean fin thickness to the geometric pitch, or spacing between adjacent fins is preferably greater than 0.2 and less than 0.8. However, as will be discussed, such a design would lead to an inefficient heat exchanger with respect to the size required to accomplish the necessary heat exchange between air and pumped oxygen streams. U.S. Pat. No. 6,951,245 discloses another brazed aluminum plate-fin heat exchanger that employs straight fins.

As will be discussed, among other advantages, the present invention provides a method of producing an oxygen product as a supercritical fluid that involves heating a pumped liquid oxygen stream with the use of supercritical pressure air in which a relationship has been determined that will allow the power consumed by the air compressor to be minimized and that can be used in connection with a heat exchanger design that will incorporate a more efficient fin design than disclosed in the prior art.

SUMMARY OF THE INVENTION

In one aspect, the present invention provides an apparatus for producing an oxygen product from a liquid oxygen stream having a purity of no less than about 90 percent by volume. In accordance with this aspect of the present invention, a pump is provided to pump the liquid oxygen stream, thereby to produce a pumped liquid oxygen stream. A compressor is provided to compress air and thereby to produce a compressed air stream and a heat exchanger is connected to the pump and the compressor such that the pumped liquid oxygen stream is heated within a heat exchanger through indirect heat exchange with at least the compressed air stream to produce the oxygen product. In this regard, the term "at least" as used herein and in the claims in this context, is meant to cover a banked heat exchange process in which the only heating stream is the air stream or alternatively a heat exchanger in which there might be other streams that would serve a heating function, albeit at a much lesser extent, such the main air stream and boosted streams to be passed into a turboexpander to generate refrigeration in an air separation plant. The pump is configured to pump the liquid oxygen stream so that the pumped liquid oxygen stream is pressurized to an oxygen pressure in a range above about 55 bar(a) and no greater than about 150 bar(a) upon entering the heat exchanger. The compressor is configured to compress the air so that the air is compressed to an air pressure upon entering the heat exchanger equal to about a value given by an equation in which the air pressure$=0.00003\times(\text{oxygen pressure})^3-(0.01141\times(\text{oxygen pressure})^2)+2.263\times(\text{oxygen pressure})+2.5175$. The heat exchanger is configured such that the pumped liquid oxygen stream is heated within the heat exchanger to a temperature at which the oxygen product will be a supercritical fluid. This apparatus, described above performs a method in accordance with the present invention in which a liquid oxygen stream having a purity of no less than about 90 percent by volume is pumped to produce a pumped liquid oxygen stream that is heated within a heat exchanger through indirect heat exchange with at least a compressed air stream to produce the oxygen product. The pumped liquid oxygen stream is pressurized by the pumping to an oxygen pressure in a range above about 55 bar(a) and no greater than about 150 bar(a) upon entering the heat exchanger and the pumped liquid oxygen stream is heated within the heat exchanger to a temperature at which the oxygen product will be a supercritical fluid. The air is compressed to an air pressure upon entering the heat exchanger at an air pressure equal to about a value given by the equation set forth above. As used herein and in the claims, the "temperature" is any temperature at or above the supercritical temperature of oxygen which will be at and above 154.78 K.

As will be discussed, when the air stream is compressed to the air pressure in accordance with the equation above, the energy of compression will always be at or very close to a minimum at a given heat exchanger duty. It is to be also noted that although such a heat exchanger could be free-standing to deliver oxygen at pressure from a liquid source, the heat exchanger could be incorporated within an air separation plant. In such case, the air pressure, for reasons that will also be discussed, although not necessarily at the minimum could be equal to a value within a range of no less than 10 percent below and 20 percent above the quantity determined from the equation set forth above. In this regard, in other aspects, the present invention provides an air separation plant and a related method for producing an oxygen product. As to the method, the present invention provides a method as set forth above in which the liquid oxygen stream is produced within an air separation plant. In accordance with air separation plant aspect of the present invention, a compressor is provided to compress the air and a pre-purification is connected to the compressor to purify the air and thereby to produce a compressed and purified air stream. A booster compressor is connected to the pre-purification unit. At least one heat exchanger is connected to the pre-purification unit and the booster compressor and is configured such that part of the compressed and purified air stream is cooled within the at least one heat exchanger and a further part of the compressed and purified air stream is compressed in the booster compressor to form a compressed air stream that is cooled within the at least one heat exchanger. An air separation unit is connected to the at least one heat exchanger so as to receive the part of the compressed and purified air stream and the compressed air stream after having been cooled and is configured to rectify the air and thereby produce a liquid oxygen stream having an oxygen purity of no less than about 90 percent by volume.

A pump connected to the air separation unit to pump the liquid oxygen stream, thereby to produce a pumped liquid oxygen stream. The at least one heat exchanger is positioned between the pump and the booster compressor and is also configured such that the pumped liquid oxygen stream is heated within the at least one heat exchanger through indirect heat exchange with at least the compressed air stream to produce the oxygen product at a supercritical temperature, at which the oxygen product will be a supercritical fluid and the compressed air stream will be a liquid. The pump is configured to pump the liquid oxygen stream so that the pumped liquid oxygen stream is pressurized to an oxygen pressure in a range above about 55 bar(a) and no greater than about 150 bar(a) upon entering the heat exchanger. The booster compressor is configured to compress the compressed air stream so that the compressed air stream has an air pressure upon entering the at least one heat exchanger equal to a value within a range of no less than ten percent below and no greater than 20 percent above a quantity equal to $0.00003\times(\text{oxygen pressure})^3-(0.01141\times(\text{oxygen pressure})^2)+(2.263\times(\text{oxygen pressure})+2.5175$.

The at least one heat exchanger can be a first heat exchanger and a second heat exchanger. The first heat exchanger is positioned between the pre-purification unit and the air separation unit and is configured to cool the part of the compressed and purified air stream. The second heat exchanger is positioned between the booster compressor and the pump and is configured to cool the compressed air stream and to warm the pumped liquid oxygen stream.

It is further noted that with respect to the prior art discussed above and as graphically presented in Castle, a meaningful benefit is derived at an oxygen pressure of above about 55 bar (a). The reason for this is at lower oxygen pressures, the air pressure required to vaporize the oxygen, as given by the equation set forth above, is within 10 bar or less of an air pressure contemplated in such prior art. However, the inventors herein have calculated that such a 10 bar difference corresponds to a unit power improvement of operating within such equation of at most about 0.08 kW per 1000 cfh of oxygen produced which would translate into a decrease of about 1 percent of the power expended in a booster air compressor used in an air separation plant. This in turn would represent a decrease in the overall power expenditure in the air separation plant of less than one-half a percent. As one skilled in the art would recognize, from at least a financial standpoint, given the cost of electrical power, this is not a meaningful operational improvement. However, at oxygen pressures of above 55 bar (a) when operating at air pressures derived from the above equation much more meaningful unit power improvements can be obtained and the improvements are greater as the oxygen pressure increases. For example at 80 bar(a) oxygen, the improvement in power consumption of the booster air compressor would be about 4 percent and therefore an improvement in the overall power consumption of the air separation plant of about 2 percent. At the high end of the range, 150 bar(a) oxygen, the risks associated with operating a heat exchanger able to withstand the required air pressure outweigh any power benefit leading to the use of pressures lower than that given by the above equation albeit at a higher power consumption.

In any aspect of the present invention, the indirect heat exchange between the pumped liquid oxygen stream and the air can be conducted in a plate-fin heat exchanger. In this regard, in yet a further aspect of the present invention, a plate-fin heat exchanger is provided that comprises parting sheets separated by and connected to fins to form at least air passages for a compressed air stream and oxygen passages for a pumped liquid oxygen stream. In this regard, such air and oxygen passages are "at least" formed in that, as indicated above, the present invention is equally applicable to a heat exchanger dedicated to the heating of the pumped liquid oxygen. For example, in the air separation plant discussed above where a second heat exchanger is employed in the so called "banked" design, it can be dedicated to the heating the pumped liquid oxygen stream. The fins in at least the air passages have an undulating configuration. As can be appreciated, such a heat exchanger is configured to withstand an oxygen pressure of the pumped liquid oxygen stream in a range above about 55 bar(a) and no greater than about 150 bar(a) upon entering the heat exchanger and an air pressure of the compressed air stream, upon entering the heat exchanger, equal to a value within a range of no less than ten percent below and no greater than 20 percent above a quantity equal to $0.00003\times(\text{oxygen pressure})^3-(0.01141\times(\text{oxygen pressure})^2)+(2.263\times(\text{oxygen pressure})+2.5175$.

In any aspect of the present invention, the fins in at least the air passages can be provided with a wavy or undulating configuration such that the flow path of the compressed air through the fins is increased over a straight through plain fin arrangement with the same fin thickness and pitch.

Preferably, the undulating configuration can have regular spaced points of maximum amplitude along a length dimension of each of the fins forming peaks and troughs of arcuate configuration. The peaks and the troughs are connected by straight segments of each of the fins. The wavelengths of the fins are preferably equal to about in a wavelength range no less than about 0.125 inches and no greater than about 1.5 inches.

When the oxygen pressure is at least about 80 bar(a), the air passages and the oxygen passages can have an identical configuration. The fins have a maximum amplitude greater than a pitch dimension as measured between adjacent fins. The fins can have a ratio of transverse thickness to the pitch dimension which is greater than about 0.4 multiplied by a factor that is equal to the air pressure divided by an allowable tensile stress equal to about the yield stress for a material forming the heat exchanger multiplied by a safety factor of not greater than about 0.5 and no less than about 0.15. The heat exchanger in any aspect of the present invention can be of brazed aluminum construction.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

DETAILED DESCRIPTION

Figure 1:
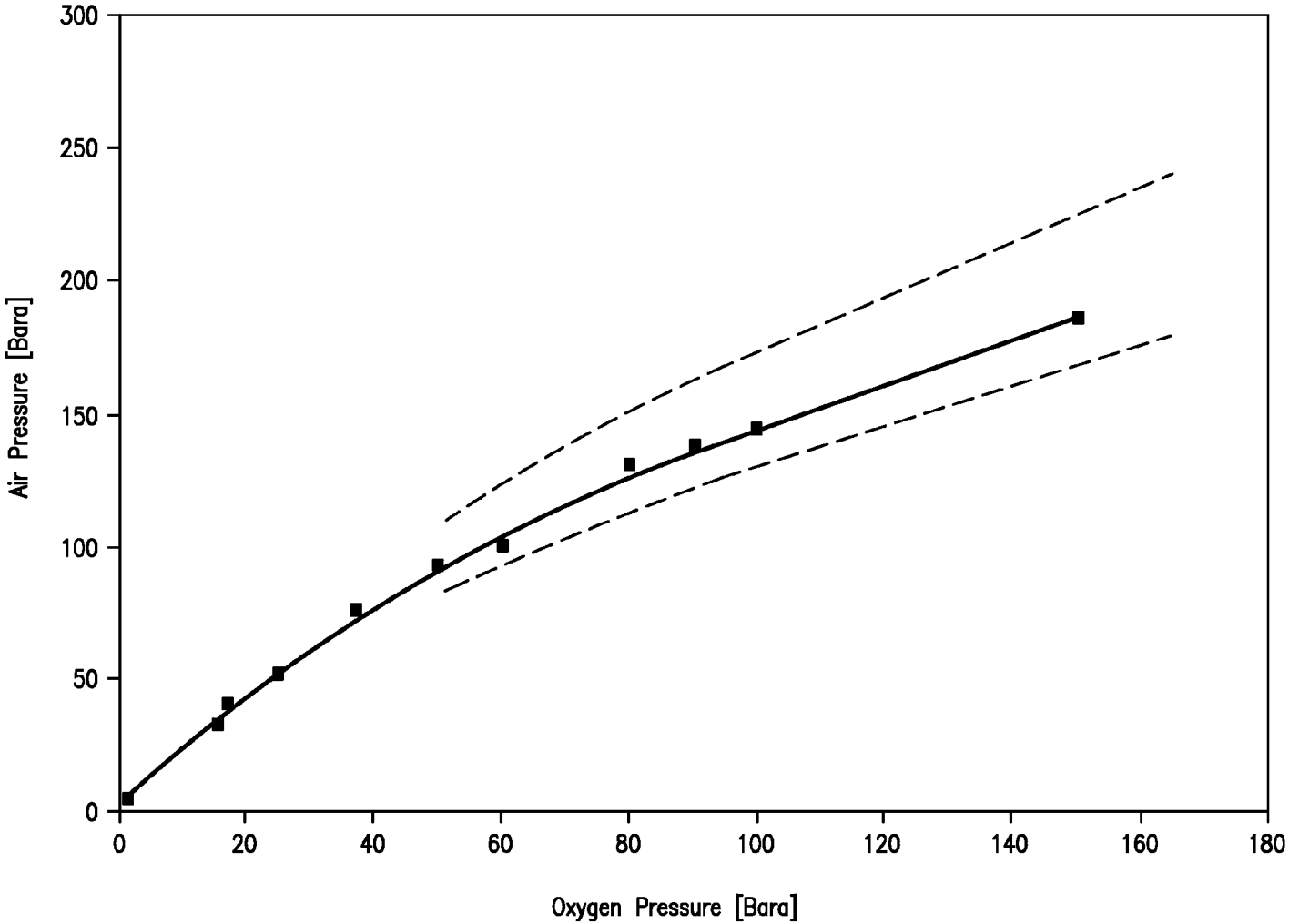
FIG. 1 is a graph of oxygen pressure versus air pressure in accordance with a preferred embodiment of the present invention that also compares such relationship with that shown in the prior art.

With reference to FIG. 1, the illustrated curve shown in a solid line represents the air pressure required to heat pumped liquid oxygen in accordance with the present invention at a particular oxygen pressure to produce an oxygen product as a result of the pumping and the heating as a supercritical fluid. When such air pressure is used, the minimum compression power will be obtained for a particular oxygen pressure.

As would be known in the art, the power expended in compressing the air has two components, namely, the pressure to which the air is to be compressed and the flow rate of the air. The air pressure and flow rate in turn must be sufficient to heat the oxygen at a specified flow rate and pressure from a pressurized liquid to a supercritical fluid after having passed through a heat exchanger. Obviously, the lower the flow rate of the air, the higher the required pressure and vice-versa that is required for a particular flow and pressure of the oxygen. Although there are many combinations of pressure and flow rate of the compressed air stream that will achieve the desired objective, it was found by the inventors herein that a specific air pressure exists for a particular pressure of oxygen to be heated that will always result in the lowest power expenditure by the air compressor when the flow rate of the air is varied to meet the thermal requirements in heating the pressurized liquid oxygen stream to an ambient temperature. In this regard, while the actual ambient temperature used in the calculations was 24.4° C. (297.55 K), the actual value of the ambient temperature would not change the results presented in the graph of FIG. 1 nor would the actual temperature of the incoming liquid oxygen, which was assumed to be at about −177° C. (96.15 K). Furthermore in any compression system, including that assumed for the calculation, the heat of compression would be removed from the air by an after-cooler, typically using water to cool the air, to the ambient temperature level prior to entering the heat exchanger. However, as with the flow rates, none of these temperatures would have any effect on the results presented in FIG. 1. Instead, such variables as flow rate and entering temperature would have an effect on the heat exchanger design used to effectuate the indirect heat exchange between the air and the oxygen.

The required flow rate of the air will depend upon the flow rate of the oxygen and the design of the particular heat exchanger used. Put another way, the flow rate of the air is dependent on a product of the overall heat transfer coefficient and the heat transfer area ("UA") and the log mean temperature difference. In any heat exchanger, the variation is dependent upon a minimum approach of the heating and cooling curves, known as the "pinch", which optimally should be no less than 1.0 K. When the pinch gets too tight, it becomes difficult to achieve the particular heat exchange desired in that small flow variations will have a large effect on the process. For an air separation plant, in order to make the plant self-sustaining without the need to add further refrigeration, another practical constraint is the warm end temperature difference at the warm end of the heat exchanger which should be practically no more than about 5 K. It is to be noted that the air compression used in boosting the air to a sufficient pressure to vaporize the pumped liquid oxygen represents about 30 percent of the power consumed by an air separation plant and hence, such power is very significant. All of this being said, the warm end temperature difference and the pinch will have no effect on the air pressure derived from FIG. 1.

Another result of FIG. 1 is the smoothness of curve 1 and that it also encompassed subcritical pressures of oxygen to be compressed that have been verified for actual optimized operating pressures of existing air separation plants. At these low pressures, the curve is fairly coincident with the results in the prior art and in particular, Castle discussed above. However, unexpectedly, a great divergence of the illustrated curve of FIG. 1 and that shown in Castle is seen at supercritical pressures of oxygen. As mentioned above, the prior art curve illustrated in this reference shows a change in the shape of the curve that would be expected given that within the heat exchanger, the oxygen is transitioning from a pressurized liquid state at the cold end to a dense, supercritical fluid at the warm end. The inventors herein have found that such change in state has no effect on the optimum power curve shown in FIG. 1. While not wishing to be limited to a particular theory of operation, it is believed by the inventors herein that the most efficient power to be expended by a compressor compressing the air versus the heat energy required to warm the pumped liquid oxygen is just that, a function of energy and nothing more, for example, a discontinuity founded upon considerations relating to a change in physical state.

In order to suitably quantify the present invention in a manner in which the current invention could be applied, the points making up the illustrated curve were generalized by polynomial curve fitting techniques in which it was found that the most efficient air pressure, from the standpoint of electrical power input to a compressor, required to vaporize the pressurized liquid oxygen is given by an equation in which the air pressure$=0.00003\times(\text{oxygen pressure})^3-(0.01141\times(\text{oxygen pressure})^2)+(2.263\times(\text{oxygen pressure})+2.5175$. When this curve is used, it was found that statistically, the variation of the curve from the actual points used in making the curve is roughly 0.995 or nearly infinitesimal. The actual points used in making up the curve are shown as small squares. Each square above 55 bar(a) represents a calculated minimum power for the air at a particular oxygen pressure that was determined by conducting a series of simulations around each point using the UNSIM DESIGN computer program that is offered by Honeywell International Inc. of Morristown, N.J., United States of America. The points below 55 bar(a) were actual optimized points used in air separation plants.

Figure 2:
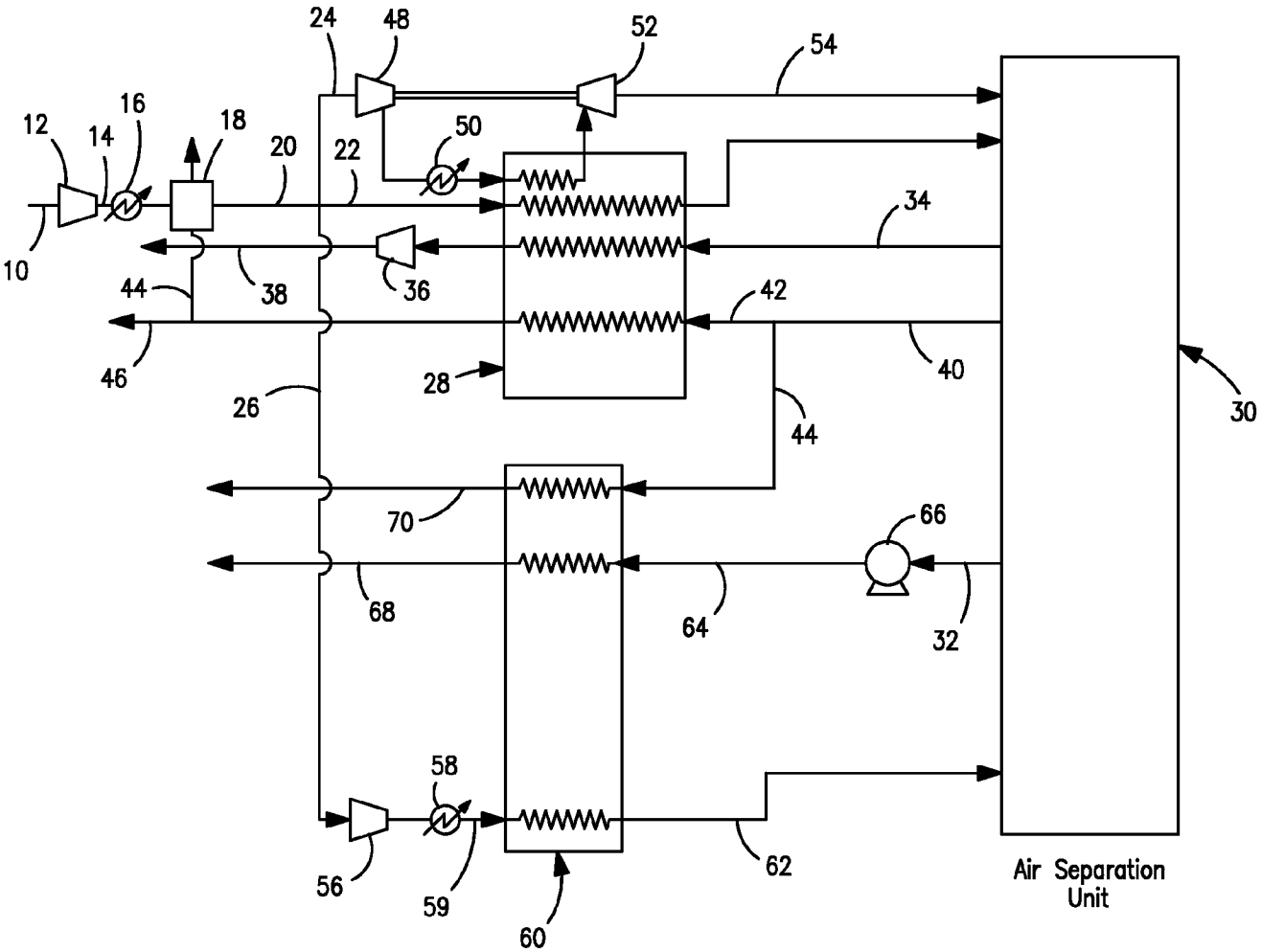
FIG. 2 is a schematic diagram of an air separation plant in which an oxygen product is pumped and vaporized.

With reference to FIG. 2, a schematic diagram of an air separation plant 1 that is used to make an oxygen product at supercritical pressures is illustrated. Although air separation plant 1 is an air expanded double column plant that is used to make oxygen and nitrogen products, the present invention would have application to any air separation plant in which a liquid oxygen product were produced and then pumped to a supercritical pressure. In this regard, while oxygen can be produced by air separation plants at a purity ranging from very low purity, about 90 percent by volume to a high purity, above 99 percent by volume oxygen, the results presented in FIG. 1 would not be affected by a measurable amount with respect to oxygen purities of about 90 percent and above. Moreover, as indicated above, the present invention is equally applicable to any compression of air in heating pumped liquid oxygen. For example, instead of air separation plant 1, a stream of liquid oxygen might be obtained from a tank containing the liquid oxygen, such stream would then be pumped and then vaporized in a vaporizer in which the compressed air were the heat transfer medium.

In air separation plant 1, an air stream 10 is compressed by a compressor 12 to produce a compressed air stream 14. Compressed air stream 14 is then passed through an after-cooler 16 to remove the heat of compression and is introduced into a prepurification unit 18. Prepurification unit 18 removes higher boiling contaminants in the air such as carbon dioxide, water vapor and potentially flammable hydrocarbons. The resulting compressed and purified air stream 20 is then divided into first, second and third subsidiary streams 22, 24 and 26.

First subsidiary stream 22 is fully cooled in a heat exchanger 28 to a temperature suitable for its rectification and then passed into an air separation unit 30 that can consist of a high pressure distillation column thermally linked to a low pressure distillation column to separate the air into an oxygen-rich liquid stream 32 withdrawn from the base of the low pressure column and a nitrogen-rich vapor stream 34 withdrawn from the top of the high pressure column. Nitrogen-rich vapor stream 34 can be fully warmed to ambient temperature within heat exchanger 28 and then compressed in a product compressor 36 to produce a nitrogen product stream 38. An impure nitrogen stream 40 can be withdrawn from the low pressure column, below the nitrogen-rich vapor stream, and then divided into first and second portions 42 and 44. First portion 42 is fully warmed within heat exchanger 28 and a part 44 thereof is used in regenerating adsorbent beds within the prepurification unit 18 and part 46 is discharged as a waste stream.

The second portion 24 of compressed air stream 20 is compressed in a booster compressor 48 and, after removal of the heat of compression in an after-cooler 50, is partially cooled to a temperature between the warm and cold ends of heat exchanger 28 and is introduced into a turboexpander 52 to produce an exhaust stream 54. Exhaust stream 54 could be introduced into the low pressure column to impart refrigeration into the air separation plant 1. As illustrated, turboexpander 52 is coupled to compressor 48 to drive the same with the work of expansion. It is also possible that the exhaust stream 54 be introduced into the high pressure column to impart the refrigeration. Nitrogen or waste expansion is also possible.

Third portion 26 of the compressed air stream 20 is introduced into a booster compressor 56 and, after removal of the heat of compression in an after-cooler 58, forms a compressed air stream 59 that is fully cooled within a heat exchanger 60 into a liquid stream 62. The compressed air stream 59 is the compressed stream that is used in heating a pumped liquid oxygen stream 64 that is formed by pumping oxygen-rich liquid stream 32 in a pump 66 and thereby producing an oxygen product stream 68. Pumped liquid oxygen stream 64 has a pressure that is above about 55 bar (a) which is above the critical pressure. As such, upon fully warming the pumped liquid oxygen stream 64, the resulting oxygen product stream at ambient temperatures is a supercritical fluid. It is to be noted that in lieu of the heat exchangers 28 and 60, a common heat exchanger could be used. Such a heat exchanger would have no effect on the optimum air pressure calculated on the basis of the data presented in FIG. 1.

Although not illustrated, the liquid stream 64 is expanded, either in a liquid expander to generate additional refrigeration or in an expansion valve so that the liquid can be introduced into the columns. The resulting liquid after expansion could be divided into two portions for introduction into intermediate locations of the high and low pressure columns. Second part 44 of the waste stream 40 is fully warmed within heat exchanger 60 and discharged as another waste stream 70. As would also be known to those skilled in the art, second part 44 of waste steam 40 is used to thermally balance the heat exchangers 28 and 60 so that the difference between warm end temperatures of the streams exiting the lower pressure heat exchanger 28 and the higher pressure heat exchanger 68 to inhibit warm end losses of refrigeration by such heat exchangers and also to decrease the temperature difference of the liquid stream 62 and the first portion 22 of the compressed and purified air stream 20 at the cold end of the high pressure heat exchanger 60 and the low pressure heat exchanger 28. In this way, the temperature difference between the liquid stream 60 and the pumped liquid oxygen stream 64 at the cold end of the higher pressure heat exchanger 60 can be optimized. It is advantageous to decrease the temperature difference at the cold end of the higher pressure heat exchanger 60 in that the boosted pressure air liquefies within such heat exchanger and then thereafter, must be expanded for its introduction into at least the lower pressure column but also, potentially, the higher pressure column. If the temperature of this stream is too warm, vapor will evolve from the boosted pressure air during the expansion to have a deleterious effect on the requisite distillation of the air to produce the desired products.

In carrying out the present invention, compressed air stream 59 upon entering heat exchanger 60 has a pressure determined in a manner indicated in FIG. 1 for a particular pressure of pumped liquid oxygen stream 64. However, in certain circumstances it might be necessary to compress second portion 26 of compressed and purified air stream 20 either above or below the pressure determined in FIG. 1. For example, if more liquid were required, it would be necessary to produce compressed air stream 59 at a pressure above that determined in FIG. 1 to generate more refrigeration within a liquid expander. By the same token, there are situations in which it is desired to form compressed air stream 59 at a pressure below the value determined in FIG. 1. In the illustrated embodiment, a specific heat exchanger design for heat exchanger 60 that would be capable of operating at a higher pressure than heat exchanger 28 would be more expensive. Costs could be saved by operating heat exchanger 60 at a lower pressure. In either of these two situations, efficiency with respect to booster compressor 56 would be lost. At a higher pressure, more energy would be expended than would be necessary to warm the pumped liquid oxygen stream 64 and at a lower pressure, the flow rate of second portion 26 of compressed and purified air stream 20 would have to be increased and as a result more energy would also be expended in power booster compressor 56. However, there are practical limits on this. One would not want to operate in a less than efficient manner by more than about 1 percent of the power associated with compression of the product oxygen flow. It was found that uniformly, operations that are conducted within a range of no more than ten percent below and 20 percent of the air pressure for compressed air stream 50 as determined from the solid line in FIG. 1 will be well within the 1 percent efficiency differential. In FIG. 1, the dashed line located above the solid line represents the pressure that is about 20 percent above and the dashed line located below the solid line represents the pressure that is about 10 percent below the air pressure derived from the solid line.

There are additional reasons for not operating exactly on the curve illustrated in FIG. 1. For example, most heat exchangers such as heat exchanger 60 are oriented in a vertical position. As such, there is a pressure loss as the oxygen ascends within such heat exchanger and a gain of liquid heat for the air that is liquefied at the bottom of the heat exchanger. Moreover, the efficiency is that of booster compressor 56 and not necessarily that of the entire air separation plant. As mentioned above, roughly 30 percent of the incoming air is sent to compressor 56. The exact amount can be balanced with the amount of air sent to booster compressor 48 for purposes of generating refrigeration. For example, if heat exchanger 60 incorporates a more compact design, the warm end temperature difference will be greater requiring an additional amount of refrigeration to be generated. At the same time, however, the more compact heat exchanger would be less expensive to build than a larger heat exchanger. Thus, the pressure selected for booster compressor 56 might under those circumstances be higher than that predicted by the curve shown in FIG. 1 given the low flow to booster compressor 56.

An air separation plant having the features of the air separation plant illustrated in FIG. 2 was simulated with the use of the UNISIM DESIGN computer program and at a series of oxygen pressures, an air pressure was found for each oxygen pressure that produced a minimum unit power. Table 1, set forth below, shows such calculation for a pumped liquid oxygen stream 64 pumped to 100 bar(a) and a flow rate of 5326 kcfh. As illustrated, the minimum unit power for booster compressor 56 occurs at 138 bar(a) (2000 psia).

TABLE 1

| Pressure Bar (a) | Pressure psia | Unit Power (KW/Kcfh) | Pinch K | Warm End Temp. Diff (WEDT)K | UA Btu/hK |
|---|---|---|---|---|---|
| 124 | 1800 | 18.58 | 1.229 | 3.302 | 5.71E+7 |
| 131 | 1900 | 18.56 | 1.182 | 3.598 | 5.71E+7 |
| 138 | 2000 | 18.55 | 1.021 | 3.929 | 5.71E+7 |
| 145 | 2100 | 18.57 | 1.008 | 4.277 | 5.71E+7 |
| 152 | 2200 | 18.6 | 0.983 | 4.63 | 5.71E+7 |

Table 2 illustrates the effect on the pressure when the UA is varied by about 20 percent from the base case shown in Table 1. Again the minimum unit power for booster compressor 56 is found to be 138 bar(a) (2000 psia).

TABLE 2

| Pressure Bar (a) | Pressure psia | Unit Power (KW/Kcfh) | Pinch K | Warm End Temp. Diff (WEDT)K | UA Btu/hK |
|---|---|---|---|---|---|
| 131 | 1900 | 18.42 | 1.229 | 0.793 | 6.86E+7 |
| 138 | 2000 | 18.41 | 1.182 | 0.773 | 6.86E+7 |
| 145 | 2100 | 18.44 | 1.021 | 0.695 | 6.86E+7 |
| 131 | 1900 | 18.83 | 2.212 | 4.09 | 4.57E+7 |
| 138 | 2000 | 18.81 | 2.225 | 4.391 | 4.57E+7 |
| 145 | 2100 | 18.82 | 2.125 | 4.388 | 4.57E+7 |

As is apparent, holding all other factors constant, varying the UA by making the heat exchanger larger or smaller has no effect on the optimum pressure. What is affected is the pinch, the warm end temperature difference and the unit power for the booster compressor 56. For example at the case of a UA 20 percent less than the base case, the pinch becomes 2.225 and the warm end temperature difference rises to 4.391. The unit power has increased to 18.81. As expected with a larger heat exchanger, the pinch and warm end temperature difference has decreased along with the unit power. However, such decrease is at the expense of fabricating a larger heat exchanger. These results can be generalized in that larger or smaller UA's would exist at higher and lower flow rates and yet, the optimum pressure found in FIG. 1 for a particular oxygen pressure would not vary.

In the practice of the present invention, the oxygen pressure sets the air pressure in accordance with FIG. 1. Once this pressure is fixed, a heat exchanger is designed that will accomplish an efficient warm end temperature difference to lower overall power requirements for compressing the air, while balancing the capital cost of the heat exchanger. Although the use of such a plate-fin heat exchanger is preferred, other designs could be used such as prior art spiral heat exchangers in connection with FIG. 1. However, in a heat exchanger of the present invention, a brazed aluminum plate-fin heat exchanger is used that unlike prior art high pressure designs that incorporate a straight fin structure, an undulating fin structure is provided for increasing the flow path length generating turbulence and mixing in the flow and thereby to effectuate an efficient heat exchanger design. Heat transfer is enhanced with the use of such fins by extension of the flow path length (more heat transfer surface), breaking of the boundary layer as a result of periodic changes of the flow direction and impingement of the flow on to the neighboring fin surface. The intensity of such effects depends on the fin pitch "P", wave length "L", amplitude "A" and fin thickness "T". When the amplitude "A" is less than the fin pitch "P", the channel flow path length is not increased, merely roughened. While this will enhance heat transfer somewhat, there will not be the enhancement that exists when amplitude "A" is greater than the pitch "P".

Figure 3:
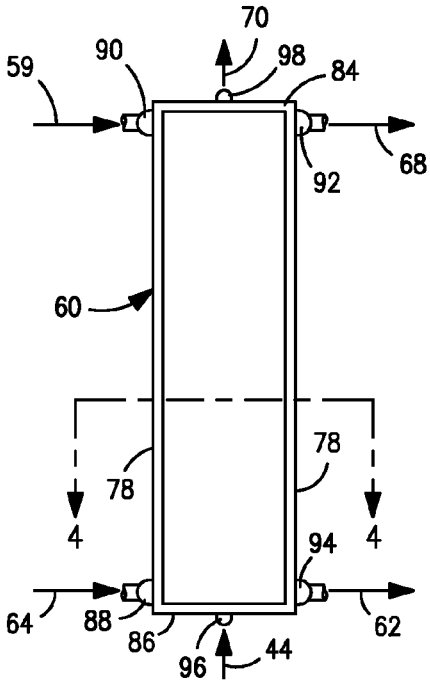
FIG. 3 is a heat exchanger in accordance with the present invention.
Figure 4:
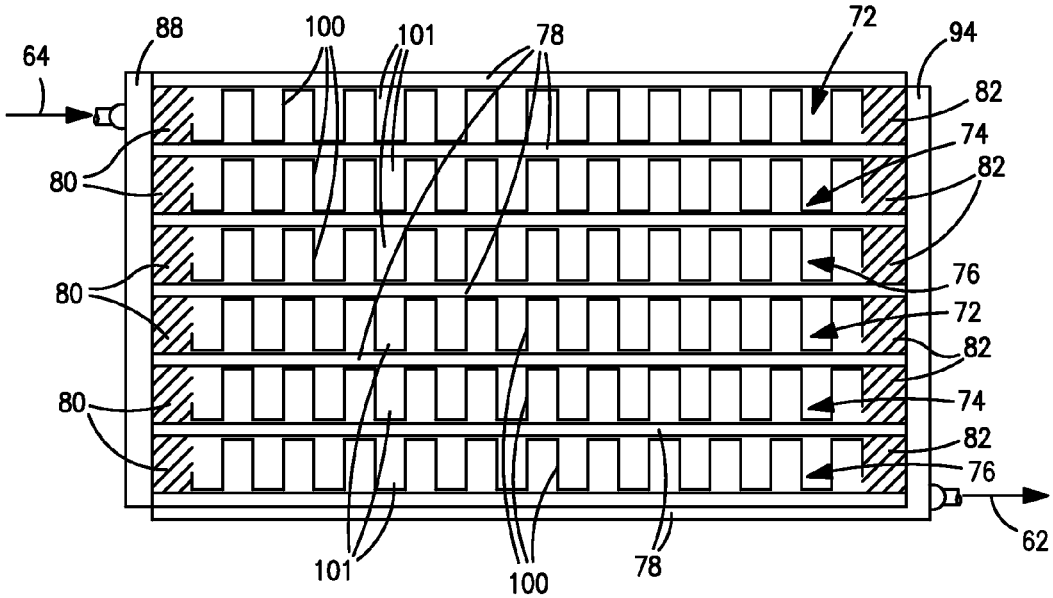
FIG. 4 is a schematic, sectional view of the heat exchanger shown in FIG. 3 taken along line 3-3 of FIG. 3.

Such a design, as generally outlined above, is preferably incorporated into a practical embodiment of heat exchanger 60 and is shown in FIGS. 3 and 4. Heat exchanger 60 is in the form of a brazed aluminum fin heat exchanger. Such a heat exchanger has at least a series of oxygen passages 72 for the oxygen to be warmed in the formation of the oxygen product stream 68, air passages 74 for the compressed air stream to be fully cooled into the two phase stream 62 and nitrogen balance passages 76 for passage of the part 44 of the nitrogen waste stream 40 for thermal balancing purposes. Each of the passages is formed between parting sheets 78 and sealed at opposite sides by blocks 80 and 82 at the ends by end blocks that are not illustrated. The top and bottom of such a heat exchanger is sealed by top and bottom cap sheets 84 and 86. It is to be understood, however, that FIG. 4 is a schematic and in a practical installation there would be many more passages than those illustrated.

The compressed air stream 59 and the pumped liquid oxygen 64 stream are introduced into the oxygen passages 72 and the air passages 74 by inlet headers 88 and 90 and the oxygen product stream 68 and the liquid stream 62 are discharged from the oxygen passages 72 and the air passages 74 by outlet headers 92 and 94. Similarly, the part 44 of the nitrogen waste stream 40 is introduced into the nitrogen passages 76 and discharged as waste stream 70 through inlet and outlet headers 96 and 98, respectively. All of such construction is conventional and well known in the art.

Figure 5:
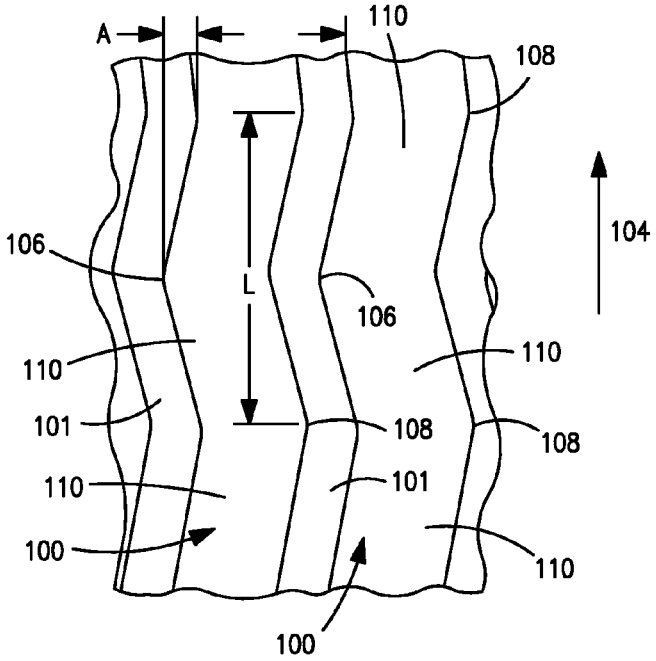
FIG. 5 is a fragmentary, plan view of an arrangement of fins in the heat exchanger shown in FIG. 3 with portions of such heat exchanger broken away.
Figure 6:
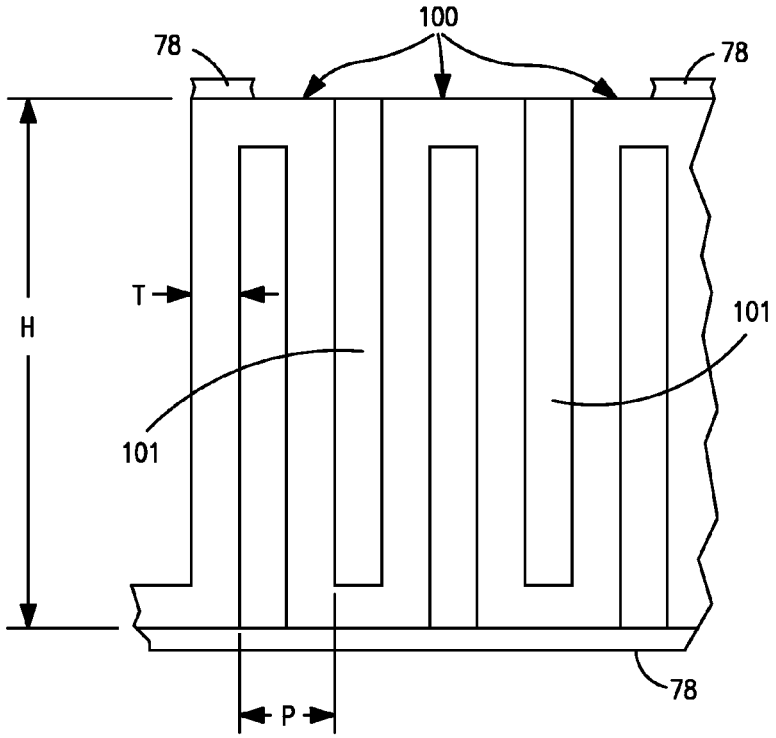
FIG. 6 is a fragmentary, elevational transverse view of FIG. 5.

Within the passages are fins 100. The fins 100 serve to maintain the structural integrity of heat exchanger 78 and to provide a greater surface area for heat transfer to occur. Fluids pass within passages 101 located between fins 100. In the prior art, such fins are extruded straight sections. However, in accordance with the present invention and as more specifically illustrated in FIGS. 5 and 6, the fins 100 have an undulating configuration in order to impart flow separations to the flow through the passages and therefore a greater heat transfer coefficient. As discussed above, the velocity of the flow passing through the undulating fins 100, at least the air flow, but possibly the oxygen flow if such fin design is also used for the oxygen passages, is selected to produce such flow separations that can either be within a transition between laminar and turbulent flow or at turbulent flow. In this regard, the velocity is selected to produce a Reynolds number of greater than about 400 as defined at a temperature midway between the warm and cold end temperatures of the heat exchanger. Such Reynolds number would at least produce flow within the transition region. Since Reynolds number is a ratio of the product of mean velocity, hydraulic diameter and fluid density to the dynamic viscosity of the fluid, the calculation of the required velocity is a simple calculation from such relationship. This undulating configuration has regular spaced points of maximum amplitude along a length dimension 104 of each of the fins 100 that form peaks 106 and troughs 108 of arcuate configuration. The purpose of the arcuate configuration is to eliminate pressure drop losses that would otherwise be produced by excessive turbulence had the peaks and troughs been sharp points. Straight segments 110 connect the peaks 106 and the troughs 108.

In accordance with the above discussion, the fins 100 have a maximum amplitude "A" greater than a pitch dimension "P" as measured between adjacent fins 100. In order to maintain structural integrity, the fins having a transverse thickness equal to the pitch dimension "P" which is greater than about 0.4 multiplied by a factor that is equal to the air pressure of compressed air stream 59 divided by an allowable tensile stress equal to about the yield stress for a material forming the heat exchanger multiplied by a safety factor of not greater than about 0.5 and preferably not less than 0.15. A safety factor of 0.25 is typically used. Practical wavelengths "L" of each of the fins 100 is in a wavelength range no less than about 0.125 inches and no greater than about 1.5 inches. It is to be noted that in the illustration, all of the fins are of identical design. However, for oxygen pressures of the pumped oxygen stream 64 that are less than about 80 bar (a) the fins 100 within the oxygen passages 72 could be made thinner in that such fins would not be subjected to the same degree of stress induced by the compressed air stream 59 in the air passages 74. Although not illustrated, it is also possible to employ a perforated material to form the fins 100. The perforations provide added turbulence but at the expense of some loss of structural strength. When the fins used for compressed air and oxygen are the same thickness, pitch amplitude etc., it is advantageous to use a perforated version of the fin for the oxygen layers.

As an example of a fin design to be used in heat exchanger 60 when used in a service discussed with respect to FIG. 1, that is a heat exchanger capable of heating oxygen pumped to a pressure of about 100 bar (a) and using an air stream having a pressure of about 138 bar (a), such heat exchanger could incorporate fins having a pitch "P" of about 0.038" and a thickness "T" of 0.016". The fin height "H" will be in a range of between about 0.1" to about 0.4". Assuming that the aluminum ALLOY 3003 were used to construct the heat exchanger, the maximum allowable tensile stress would be $24\times10^6$ Pa, which represents the ultimate tensile stress (UTS) multiplied by a safety factor of 0.25. As is apparent, the thickness to pitch ratio of the fin would be equal to 0.42. If a fin thickness of 0.020 were used, the corresponding pitch would need to be 0.05" (20 fins per inch). However, the preferred mode is to use a smaller pitch and corresponding thickness to maintain the ratio thickness to pitch of greater than about 0.42. This is because the surface area will be higher for higher pitch. The same fin design could be used for both the air and the oxygen passages 74 and 72 respectively in case of heat exchanger 60. The heat exchanger, for example, heat exchanger 60 would then be designed with respect to the number of layers, the arrangement of layers and the flow area within each of the layers in a manner well known to anyone skilled in the art.

While the present invention has been described with reference to a preferred embodiment, as will occur to those skilled in the art numerous additions, omissions and changes can be made to such embodiment without departing from the spirit and scope of the present invention as set forth in the appended claims.

We claim:

1. A method of producing an oxygen product comprising:

pumping a liquid oxygen stream having a purity of no less than about 90 percent by volume to produce a pumped liquid oxygen stream;

heating the pumped liquid oxygen stream within a heat exchanger through indirect heat exchange with at least a compressed air stream to produce the oxygen product; and the pumped liquid oxygen stream being pressurized by the pumping to an oxygen pressure in a range above about 55 bar(a) and no greater than about 150 bar(a) upon entering the heat exchanger, the pumped liquid oxygen stream being heated within the heat exchanger to a temperature at which the oxygen product will be a supercritical fluid and the air being compressed to an air pressure upon entering the heat exchanger equal to about a value given by an equation in which the air pressure=$0.00003\times(\text{oxygen pressure})^3-(0.01141\times(\text{oxygen pressure})^2)+2.263\times(\text{oxygen pressure})+2.5175$.

2. A method of producing an oxygen product comprising:

pumping a liquid oxygen stream produced within an air separation plant at a purity of no less than about 90 percent by volume, thereby to produce a pumped liquid oxygen stream;

heating the pumped liquid oxygen stream within a heat exchanger of the air separation plant through indirect heat exchange with at least a compressed air stream to produce the oxygen product; and the pumped liquid oxygen stream being pressurized to an oxygen pressure in a range above about 55 bar(a) and no greater than about 150 bar(a) upon entering the heat exchanger, the pumped liquid oxygen stream being heated within the heat exchanger to a temperature at which the oxygen product will be a supercritical fluid and the compressed air stream formed by compressing part of a compressed and purified air stream produced by compressing and purifying air within the air separation plant to an air pressure upon entering the heat exchanger equal to a value within a range of no less than ten percent below and no greater than twenty percent above a quantity equal to $0.00003\times(\text{oxygen pressure})^3-(0.01141\times(\text{oxygen pressure})^2)+2.263\times(\text{oxygen pressure})+2.5175$.

3. The method of claim 1 or claim 2 wherein:

the pumped liquid oxygen stream and the air are passed countercurrently through passages within a plate-fin heat exchanger comprising parting sheets separated by and connected to fins to form at least air passages for the air and oxygen passages for the pumped liquid oxygen stream;

the fins in at least the air passages having an undulating configuration; and the air being passed through the air passages at a velocity sufficient to induce flow separations due to the undulating configuration of the fins.

4. The method of claim 3, wherein the undulating configuration has regular spaced points of maximum amplitude along a length dimension of each of said fins forming peaks and troughs, each of the peaks and troughs having an arcuate configuration; and the peaks and the troughs being connected by straight segments of each of the fins.

5. The method of claim 3, wherein the oxygen pressure and is at least about 80 bar(a) and the air passages and the oxygen passages have an identical configuration.

6. The method of claim 4, wherein the fins have wavelengths and each of the wavelengths of the fins is no less than about 0.125 inches and no greater than about 1.5 inches.

7. The method of claim 6, wherein:

the fins have a maximum amplitude greater than a pitch dimension as measured between adjacent fins; and the fins having a ratio of transverse thickness to the pitch dimension which is greater than about 0.4.

8. The method of claim 7, wherein the heat exchanger is of brazed aluminum construction.

* * * * *